United States Patent [19]

Lock

[11] 4,053,099

[45] Oct. 11, 1977

[54] ARTICLE TRAY

[75] Inventor: Joseph H. Lock, Mableton, Ga.

[73] Assignee: The Mead Corporation, Dayton, Ohio

[21] Appl. No.: 729,357

[22] Filed: Oct. 4, 1976

[51] Int. Cl.[2] ..... B65D 5/30

[52] U.S. Cl. ..... 229/28 R; 229/39 R; 229/30

[58] Field of Search ..... 229/27, 28, 29, 30, 229/31, 39

[56] References Cited

U.S. PATENT DOCUMENTS

| | | | |
|---|---|---|---|
| 2,640,589 | 6/1953 | Foster et al. | 229/30 UX |
| 2,907,510 | 10/1959 | Vines | 229/30 X |
| 2,984,400 | 5/1961 | Kuchenbecker | 229/39 R |
| 3,037,681 | 6/1962 | Kuchenbecker et al. | 229/39 R |
| 3,140,035 | 7/1964 | Wenzel | 229/30 |
| 3,182,888 | 5/1965 | Chipley, Jr. et al. | 229/39 R |
| 3,209,980 | 10/1965 | Festa | 229/28 R |
| 3,400,875 | 9/1968 | Coe | 229/28 R |

*Primary Examiner*—Davis T. Moorhead

*Attorney, Agent, or Firm*—Walter M. Rodgers; Walter A. Rodgers

[57] ABSTRACT

An article tray comprises a bottom wall, spaced side walls foldably joined respectively to the side edges of the bottom wall, a top wall foldably joined respectively along the side edges thereof to the upper edges of the side walls, spaced end panels foldably joined respectively to the end edges of the bottom wall, a plurality of apertures formed in the top wall, the apertures adjacent the ends of the tray having a locking surface adjacent and parallel to the ends of the tray, a plurality of stabilizing tabs formed on the end panels at each end of the carrier and disposed in abutting engagement with the underside of the top wall, a plurality of locking tabs interspersed between the stabilizing tabs and formed on the end panels at each one end of the carrier and disposed within the apertures, and a pair of shoulders formed on each locking tab and disposed in an overlapping abutting relationship with the topside of the top wall, and the lower edges of the shoulders being disposed in approximately the same horizontal plane as the upper edges of the stabilizing tabs.

14 Claims, 6 Drawing Figures

ARTICLE TRAY

Article carriers of the so-called carry out tray variety are well known. One embodiment comprises a plurality of apertures formed in the top wall with a locking surface formed in the apertures at each end of the tray. In addition a plurality of locking tabs are formed on the end panels and disposed within the end apertures in abutting engagement with the locking surfaces. In general this type of tray has historically been unsatisfactory for the packaging of all but the smallest quantities of articles. This was due in large part to the inherent structural weakness in the typical carry out type tray. Therefore whenever this tray is loaded, and then transported from the point of initial use, it tends to collapse and thereby cause the loss of any articles contained in the tray.

According to this invention, an article tray is provided for the packaging of multiple articles and comprises a bottom wall, a top wall spaced above and parallel to the bottom wall, a pair of spaced end panels foldably joined respectively to the end edges of the bottom wall, at least one aperture formed in the top wall and having a locking surface disposed parallel to the ends of the tray, at least one stabilizing tab formed on the end panel at one end of the carrier and disposed in abutting engagement with the top wall on the underside thereof, at least one locking tab formed on the end panel at the one end of the carrier and disposed within the aperture in abutting engagement with the locking surface, a first shoulder formed on the locking tab and disposed in an overlapping abutting relationship with the top wall on the topside thereof, and the lower edge of the shoulder being disposed generally in the same horizontal plane as the upper edge of the stabilizing tab.

For a better understanding of the invention reference may be had to the following detailed description taken in conjunction with the accompanying drawings in which FIG. 1 is an isometric view of a complete and set up article tray constructed according to this invention;

FIG. 3 is a enlarged end view of the article tray shown in FIG. 1; and in which

Figure 1:
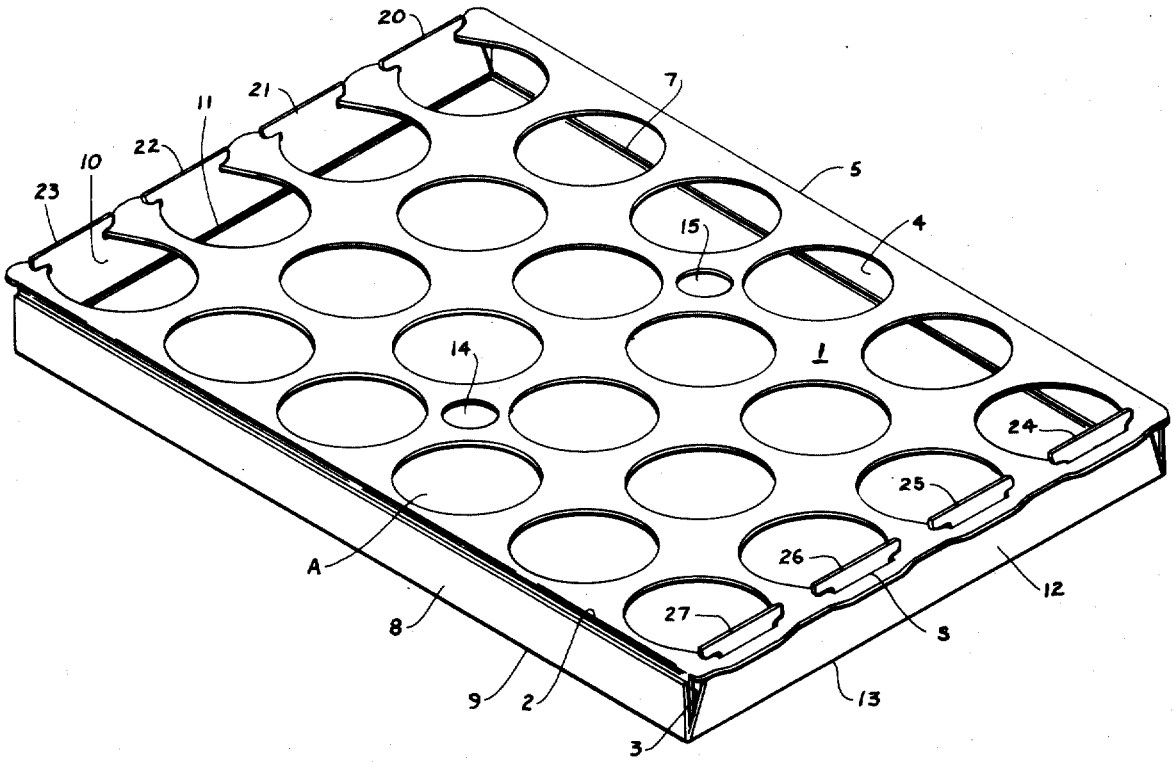

In the drawings the numeral 1 designates the top wall of the article tray to the side edge 2 of which glue flap 3 is foldably joined. On the other side of top wall 1, a side wall 4 is foldably joined thereto along fold line 5 while bottom wall 6 is foldably joined to side wall 4 along fold line 7. In addition side wall 8 is foldably joined to bottom wall 6 along fold line 9. End panel 10 is foldably joined to bottom wall 6 along fold line 11 while in similar fashion end panel 12 is foldably joined to bottom wall 6 along fold line 13.

For the purpose of receiving the articles, a plurality of apertures A are formed in top wall 1. Each aperture A which is disposed adjacent an end of the carrier is provided with a locking surface S. Also formed in top wall 1 are a pair of finger receiving apertures 14 and 15. To facilitate machine manipulation of the package, a plurality of machine element receiving apertures defined by tabs 16, 17, 18 and 19 are provided and are formed in bottom wall 6.

According to one facet of this invention, a plurality of locking tabs 20, 21, 22 and 23 are formed along the top edge of end panel 10. In like manner locking tabs 24, 25, 26 and 27 are formed on end panel 12. Each locking tab is similarly constructed and in order to simplify the description of the various components, only one locking tab will be identified in detail, it being understood that the same structure is embodied in each locking tab. Referring specifically to locking tab 24, a pair of spaced shoulders are designated by numerals 29 and 30. Disposed adjacent shoulders 29 and 30 respectively and formed on the upper edge of end panel 12 are a pair of notches 31 and 32.

According to another facet of this invention, disposed generally intermediate two associated locking tabs and formed on the upper edge of end panel 10 are stabilizing tabs 33, 34 and 35. In like manner a plurality of stabilizing tabs 36, 37 and 38 are formed on end panel 12.

Figure 2:
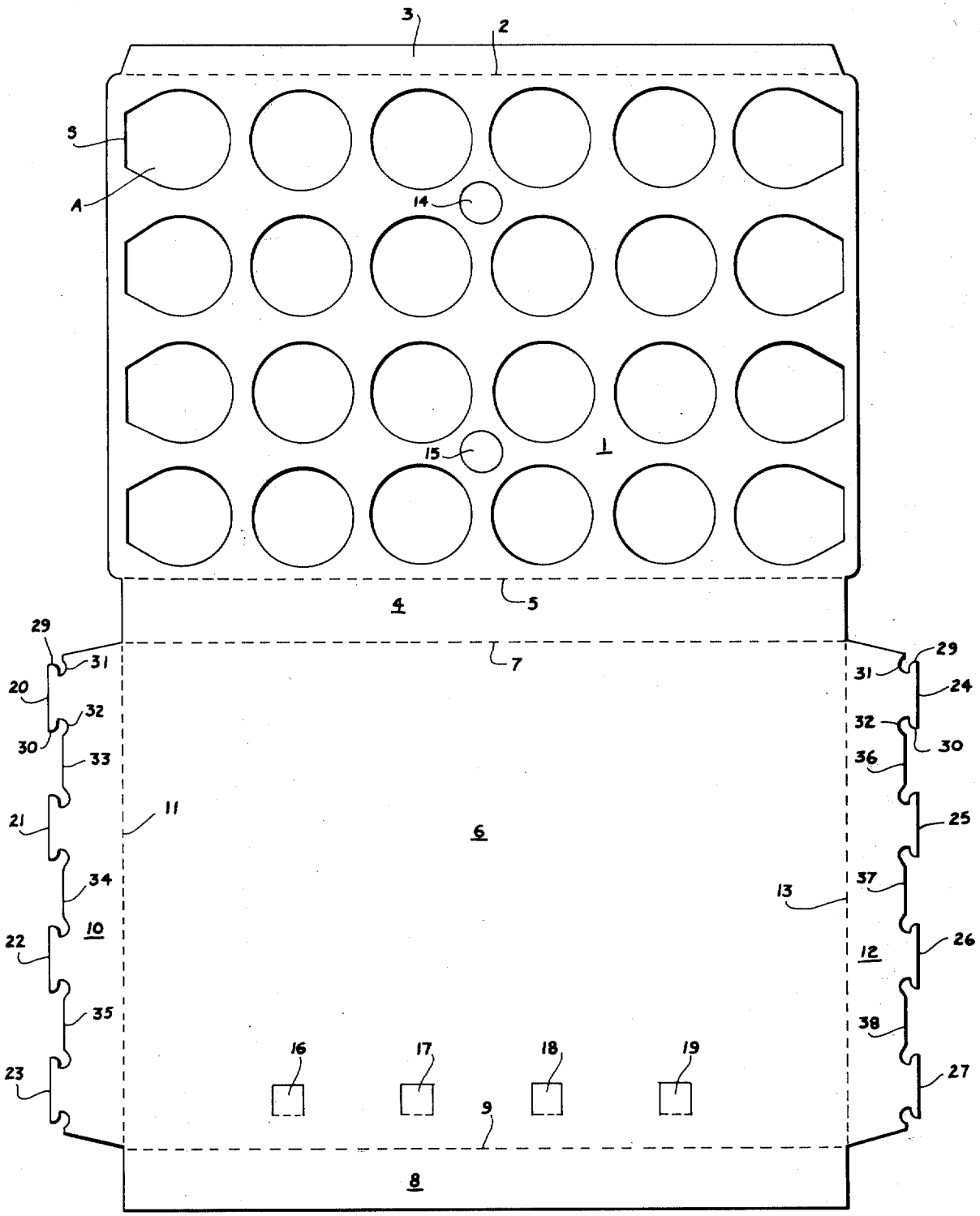
FIG. 2 is a plan view of a blank from which the article tray shown in FIG. 1 is formed.

In order to manipulate the blank shown in FIG. 2 into the completed and set up tray as shown in FIG. 1, it is simply necessary to fold top wall 1 together with glue flap 3 upwardly and forwardly along fold line 5 into flat face contacting relation with bottom wall 6 and side wall 4. Thereafter an appropriate application of glue is made to glue flap 3. Side wall 8 is then folded upwardly along fold line 9 and an edge thereof becomes adhered to glue flap 3. The tray is then disposed in collapsed condition.

In order to set up the tray, top wall 1 and bottom wall 6 are simply pulled apart and manipulated to a point where they are perpendicular to side walls 4 and 8. Thereafter each of the end panels 10 and 12 is folded upwardly along the respective fold lines 11 and 13 through an angle greater than 90° and simultaneously locking tabs 20–27 are extended through their associated apertures A. The end panels 10 and 12 are then swung generally outwardly toward the respective ends of the tray whereby locking tabs 20–27 assume an abutting relationship with the associated locking surfaces S of apertures A. The tray then appears as shown in FIG. 1.

Figure 3:
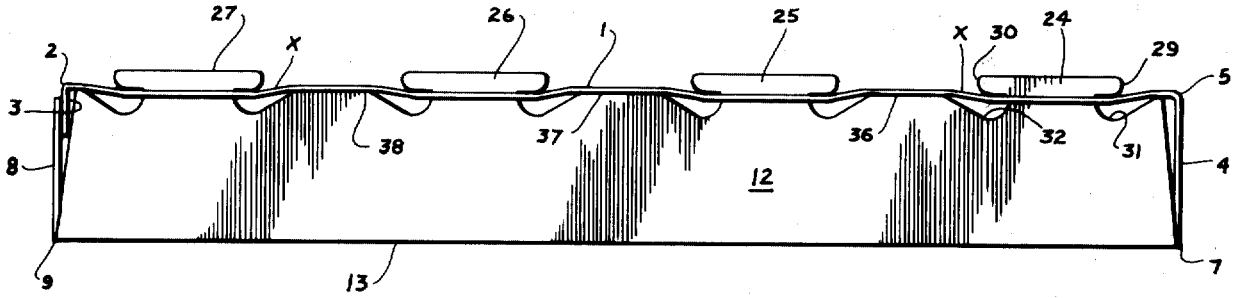

With particular reference to FIG. 3, it can be seen that the shoulders 29 and 30 of each locking tab overlap portions of top wall 1 and form an abutting relationship therewith. In addition, and as shown in FIG. 3, it can be seen that the stabilizing tabs such as 36, 37 and 38 are disposed in abutting relation with portions of top wall 1. Therefore the pressure of stabilizing tabs 36, 37 and 38 on top wall 1 at one end of the tray is in an upward direction while the pressure on top wall 1 of the appropriate shoulders 29 and 30 of each locking tab 24, 25, 26 and 27 is in a downward direction, thereby causing the end of the top wall to form a slightly undulating configuration. Also shown in FIG. 3 is the fact that the upper edges of the stabilizing tabs are disposed in generally the same horizontal plane as the lower edges of the shoulders at the point of contact with the topside of top wall 1. Therefore thickness in the tray material causes undulations X at the ends of top wall 1 and establishes a high friction gripping contact between the end panels and top wall. This imparts a substantial degree of stability to the tray and prevents twisting even though the tray may be only partially loaded. Of course the structure at the opposite end of the tray is identical to that just described. Also this combination of forces causes an upward tension force to occur on shoulders 29 and 30 of each locking tab. Therefore these forces provide for an extremely strong tray which, for all practical purposes, is prevented from inadvertant collapse. In addition the tension force prevents any undesired movement of the end panels 10 and 12 out of their locked positions.

Also according to this invention, end panels 10 and 12 are provided with notches 31 and 32 which facilitate the easy assembling the tray by providing sufficient clearance space when the locking tabs 20–27 are moved into their locked positons.

In addition, as can be seen from FIGS. 1 and 3, the ends of end panels 10 and 12 are tapered inwardly so that as each end panel is folded upwardly through an angle greater than 90° there is no interference with the associated ends of the side walls 4 and 8.

Figure 4:
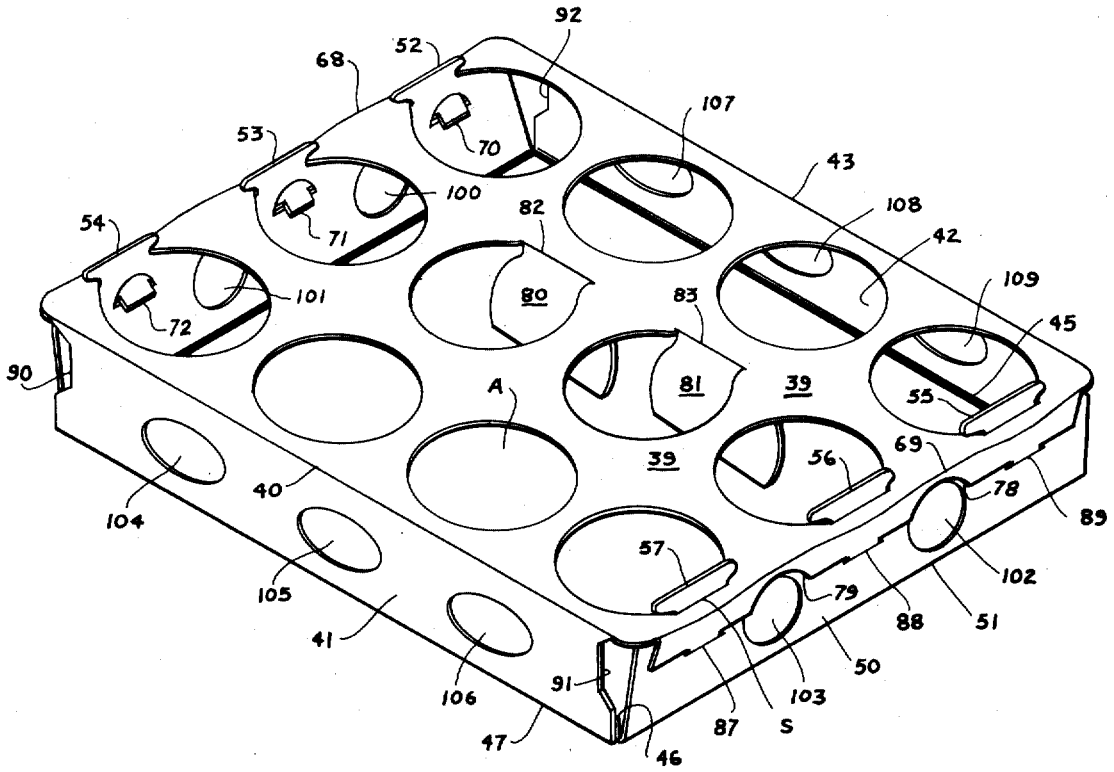
FIGS. 4, 5 and 6 depict a modification of the invention and correspond respectively to FIGS. 1, 2 and 3.
Figure 6:
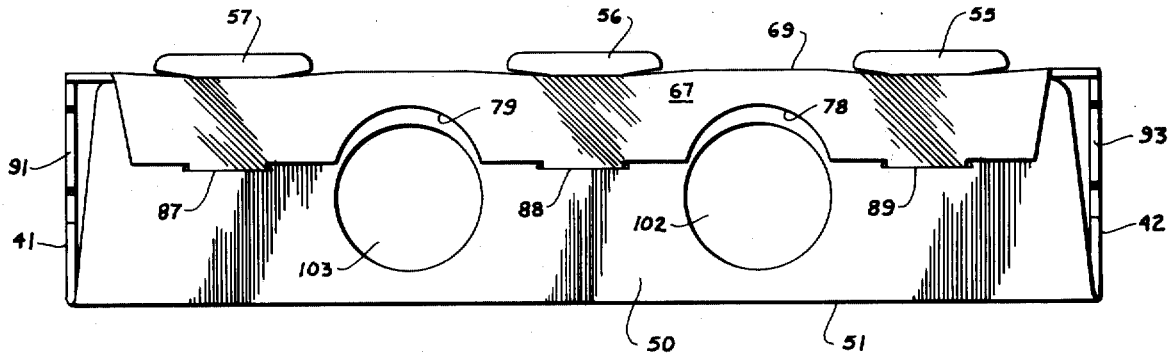
Figure 5:
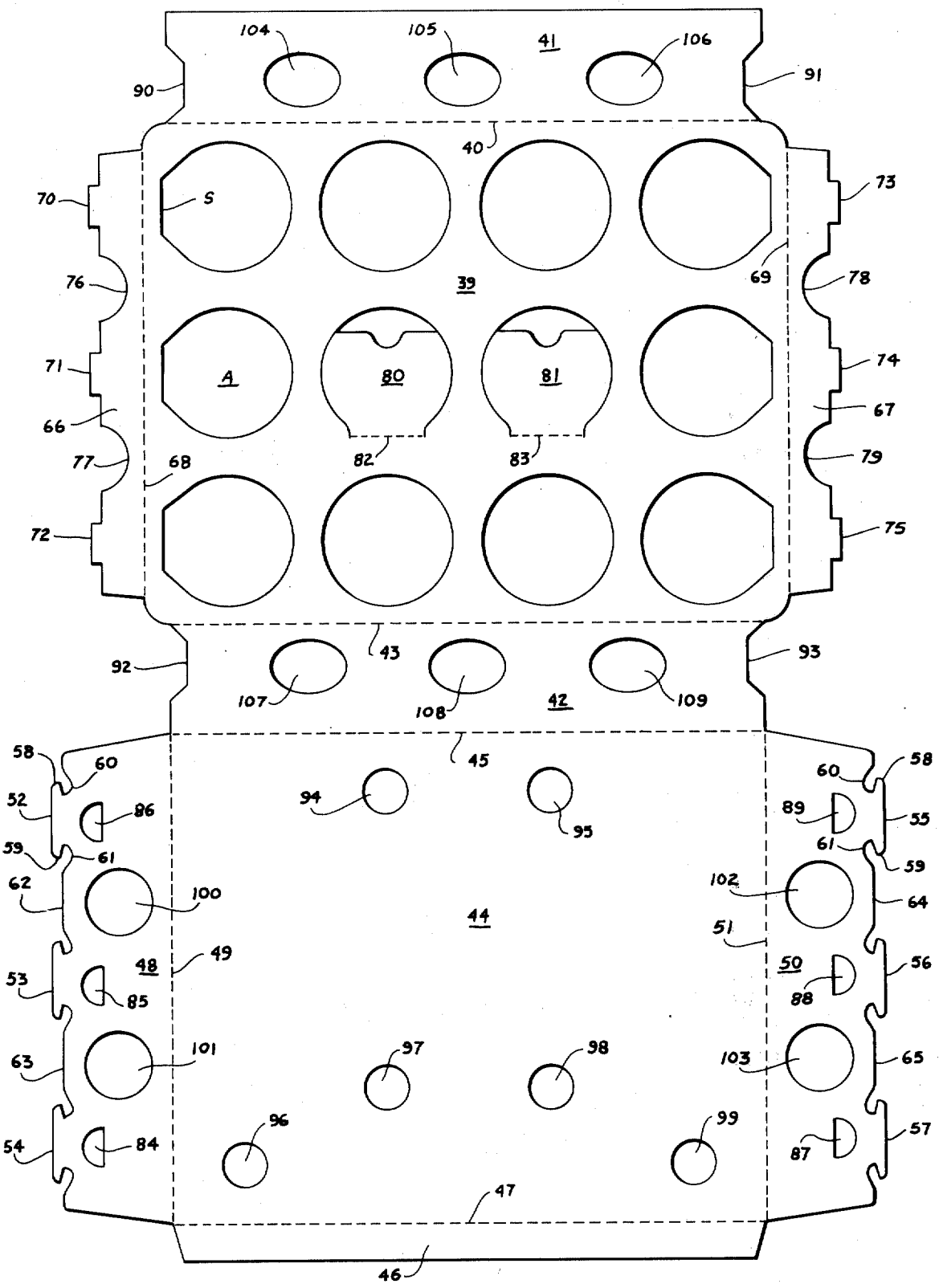

FIGS. 4, 5 and 6 show a modification of the invention which comprises a top wall 39 to the side edge 40 of which side wall 41 is foldably joined. On the other side of top wall 39, a side wall 42 is foldably joined thereto long fold line 43 while bottom wall 44 is foldably joined to side wall 42 along fold line 45. In addition glue flap 46 is joined to a side edge of bottom wall 44 along fold line 47. End panel 48 is foldably joined to bottom wall 44 along fold line 49 while in similar fashion end panel 50 is foldably joined to bottom wall 44 along fold line 51.

In similar fashion to the tray shown in FIGS. 1, 2 and 3, a plurality of aperture A are formed in top wall 39. Each aperture A which is disposed adjacent an end of the tray is provided with a locking surface S. In addition a plurality of locking tabs 52, 53 and 54 are formed along the upper portion of end panel 48. Likewise locking tabs 55, 56 and 57 are formed on end panel 50. All the locking tabs have the same features and with particular reference to locking tab 55, a pair of spaced shoulders are provided and are designated by the numerals 58 and 59. In addition, disposed adjacent shoulders 58 and 59 respectively and formed on the upper edge of end panel 50 are a pair of notches 60 and 61. Disposed generally intermediate two associated locking tabs and formed on the upper edge of end panel 48 are stabilizing tabs 62 and 63. Likewise stabilizing tabs 64 and 65 are formed on end panel 50.

According to the modified form of this invention, a pair of auxiliary panels 66 and 67 are formed respectively on the end edges of top wall 39 along fold lines 68 and 69. Formed on the end of auxiliary panel 66 are tabs 70, 71 and 72. Likewise tabs 73, 74 and 75 are formed on auxiliary panel 67. Also formed in auxiliary panel 66 and disposed intermediate two associated tabs are cutout portions 76 and 77 and; likewise, cutout portions 78 and 79 are formed in auxiliary panel 67. In order to prevent possible sag in top wall 39, stabilizing flaps 80 and 81 are foldably joined respectively to top wall 39 along fold lines 82 and 83.

For the purpose of cooperating respectively with tabs 70, 71 and 72 in the completed tray, semicircular apertures 84, 85 and 86 are formed in end panel 48. In like fashion and for the purpose of cooperating respectively with tabs 73, 74 and 75, semicircular apertures 87, 88 and 89 are formed in end panel 50. In order to facilitate the formation of the article tray, notches 90 and 91 are formed respectively on the ends of side wall 41. Likewise notches 92 and 93 are formed respectively on the ends of side wall 42. Also to aid in the machine manipulation of the tray, apertures 94, 95, 96, 97, 98 and 99 are formed in bottom wall 44.

In the event the packaged items are of the frozen variety, a series of apertures are provided to facilitate rapid freezing of the product. Specifically apertures 100 and 101 are formed in end panel 48 and apertures 102 and 103 are formed in end panel 50. In addition apertures 104, 105 and 106 are formed in side wall 41 and apertures 107, 108 and 109 are formed in side wall 42.

In order to form a completed tray as shown in FIG. 4 from the blank shown in FIG. 5, it is simply necessary first to elevate bottom wall 44 along fold line 45 into flat face contacting relation with top wall 39 and side wall 42. After an application of glue is made to glue flap 46, side wall 41 is elevated and folded along fold line 40. By this operation an edge of side wall 41 becomes adhered to glue flap 46. In order to set up the tray, top wall 39 and bottom wall 44 are separated and moved into a perpendicular relationship with side walls 41 and 42. As discussed in connection with the article tray shown in FIGS. 1, 2 and 3, end panels 48 and 50 are then folded upwardly along their respective fold lines 49 and 51 through an angle greater than 90° and, at the same time, locking tabs 52–57 are extended through their associated apertures A. The end panels 48 and 50 are then swung outwardly whereby locking tabs 52–57 assume an abutting relationship with the associated locking surfaces S of apertures A. Simultaneously with this operation, auxiliary panels 66 and 67 are swung downwardly and inwardly along their respective fold lines 68 and 69 and tabs 70, 71 and 72 are inserted respectively into semicircular apertures 84, 85 and 86 and tabs 73, 74 and 75 are inserted respectively into semicircular apertures 87, 88 and 89.

Insertion of the packaged items into the apertures A having stabilizing flaps 80 and 81 causes these flaps to assume a vertical position and helps to maintain top wall 39 in a horizontal position without sagging in the middle. Following these various folding and gluing operations the modified tray then appears as shown in FIG. 4.

Also when end panel 48 is swung through an angle greater than 90° any interference with side walls 41 and 42 is prevented by the combination of the tapered ends of end wall 48 and notches 90 and 92. Similarly end panel 50 is swung into position without inteference by the combination of the tapered ends of end panel 50 and notches 91 and 93. It therefore can be seen that the various features of this invention allow for high speed machine manipulation of the tray by eliminating any dimensional parameters which would necessitate manual manipulation.

The embodiments of the invention in which an exclusive property or privilege is claimed are defined as follows:

1. An article tray comprising a bottom wall, a top wall disposed parallel to said bottom wall, a pair of spaced side walls disposed perpendicular to said top and bottom walls, a pair of end panels foldably joined respectively to the end edges of said bottom wall, at least one aperture formed in said top wall and having a locking surface disposed on the periphery of said aperture generally adjacent and parallel to the end edge of said top wall at one end of the tray, a stabilizing tab formed on the upper edge of the end panel at said one end of the tray adjacent said aperture and disposed in abutting engagement with the underside of said top wall, a locking tab formed on the upper edge of said end panel at said one end of the tray and disposed within said aperture and in abutting engagement with said locking surface, and a first shoulder formed on said locking tab and disposed in overlapping abutting relationship with the topside of said top wall, the lower edge of said shoulder at the point of contact with said top wall being disposed generally in the same horizontal plane as the upper edge of said stabilizing tab to cause a tension force across at least a portion of said end edge of said top wall at said one end of the tray.

2. A tray according to claim 1 wherein a second shoulder is formed on said locking tab remote from said first shoulder and is disposed in an overlapping abutting relationship with the topside of said top wall.

3. A tray according to claim 2 wherein the lower edges of said shoulders diverge in a direction away from said locking tab.

4. A tray according to claim 3 wherein a pair of notches are formed respectively in the upper edge of said end panel and on opposite sides of said locking tab adjacent and below said shoulders to facilitate the entry of said locking tab into said aperture.

5. A tray according to claim 1 wherein a plurality of apertures are formed in said top wall.

6. A tray according to claim 1 wherein the end edges of said end panel at the one end of the tray converge in a direction away from said bottom wall.

7. An article tray comprising spaced apart generally parallel top and bottom walls, a plurality of apertures formed in said top wall adjacent each end edge thereof, and end panel joined along its bottom edge to each end edge of said bottom wall and disposed in substantially normal relation to said top and bottom walls, a plurality of upstanding locking tabs each having a pair of shoulders and being formed along the top edge of each of said end panels and respectively disposed in said apertures with the shoulders of each locking tab in abutting contact with the top surface of said top wall, and a plurality of upstanding stabilizing tabs formed along the top edge of each of said end panels and interspersed between said locking tabs and arranged to engage the bottom surface of said top wall, the top wall contacting parts of said shoulders being disposed at a level relative to the top wall contacting parts of said stabilizing tabs such that a frictional tray stabilizing relationship is established between said top all and said end panels.

8. A tray according to claim 7 wherein the difference in the levels of the top wall contacting parts of said shoulders and of said stabilizing tabs is less than the thickness of said top wall.

9. A tray according to claim 7 wherein the portions of the top edge of each of said end panels on opposite sides of each of said locking tabs are cutaway to allow clearance for and slight downward bowing of said top wall thereat.

10. A tray according to claim 1 wherein an auxiliary panel is foldably joined to the end edge of said top wall at said one end of the tray and wherein said auxiliary panel extends generally downwardly.

11. A tray according to claim 10 wherein an aperture is formed in said end panel at said one end of the tray and wherein a tab is formed on the lower edge of said auxiliary panel and disposed within said aperture.

12. A tray according to claim 1 wherein at least one aperture is formed in each of said side walls and in each of said end panels.

13. A tray according to claim 1 wherein a stabilizing flap is foldably joined to said top wall and is arranged to extend downwardly generally in a vertical position.

14. A tray according to claim 1 wherein a notch is formed on each end of said side walls to facilitate folding of said end panels.

* * * * *